US010720006B2

(12) United States Patent
Nelson et al.

(10) Patent No.: US 10,720,006 B2
(45) Date of Patent: Jul. 21, 2020

(54) MIXED REALITY SYSTEMS AND METHODS FOR DISPLAYING AND RECORDING AUTHORIZED REAL-WORLD AND VIRTUAL ELEMENTS

(71) Applicant: IGT, Las Vegas, NV (US)

(72) Inventors: Dwayne Nelson, Las Vegas, NV (US); Patrick Danielson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/157,488

(22) Filed: Oct. 11, 2018

(65) Prior Publication Data

US 2020/0118380 A1 Apr. 16, 2020

(51) Int. Cl.
*G07F 17/32* (2006.01)

(52) U.S. Cl.
CPC ..... *G07F 17/3211* (2013.01); *G07F 17/3216* (2013.01)

(58) Field of Classification Search
USPC ..... 463/17
See application file for complete search history.

(56) References Cited

U.S. PATENT DOCUMENTS 8,235,529 B1 8/2012 Raffle et al.
8,558,759 B1 10/2013 Prada et al.
8,821,274 B2 9/2014 Lyons et al.
8,943,420 B2 1/2015 Goldthwaite et al.
9,280,867 B2 3/2016 Froy et al.
9,280,868 B2 3/2016 Froy et al.
9,285,592 B2 3/2016 Olsson et al.
9,412,201 B2 8/2016 Kinnebrew et al.
9,558,612 B2 1/2017 Lyons et al.
9,568,620 B2 1/2017 Froy et al.
9,569,920 B2 2/2017 Froy et al.
2012/0212499 A1* 8/2012 Haddick ..... G02B 27/0093 345/589
2012/0236031 A1* 9/2012 Haddick ..... G02B 27/0093 345/633
2012/0249797 A1* 10/2012 Haddick ..... G01C 21/3629 348/158
2013/0127980 A1* 5/2013 Haddick ..... G06F 3/013 348/14.08
2014/0121015 A1 5/2014 Massing et al.
2014/0168261 A1 6/2014 Margolis et al.
2016/0373570 A1 12/2016 Scavezze et al.

* cited by examiner

*Primary Examiner* — Pierre E Elisca
(74) *Attorney, Agent, or Firm* — Sage Patent Group

(57) ABSTRACT

A mixed reality display system includes a processor circuit, and a memory coupled to the processor circuit. The memory includes machine-readable instructions that, when executed by the processor circuit, cause the processor circuit to determine a location of a user wearing a mixed reality viewer and generate a live video signal of a real-world scene including a plurality of real-world elements. The machine readable instructions further cause the processor circuit to determine an authorized region within the real-world scene including a plurality of authorized real-world elements that are authorized to be displayed to a third party, and generate a mixed reality including the authorized real-world elements within the authorized region and a first virtual element that obscures one of the plurality of real-world elements of the live video signal that is not within the authorized region of the real-world scene, and generate an output video signal of the mixed reality scene.

20 Claims, 12 Drawing Sheets

MIXED REALITY SYSTEMS AND METHODS FOR DISPLAYING AND RECORDING AUTHORIZED REAL-WORLD AND VIRTUAL ELEMENTS

BACKGROUND

Embodiments described herein relate to mixed reality systems and methods, and in particular to mixed reality systems and methods for displaying and recording authorized real-world and virtual elements. Electronic gaming machines (EGMs) are systems that allow users to place a wager on the outcome of a random event, such as the spinning of mechanical or virtual reels or wheels, the playing of virtual cards, the rolling of mechanical or virtual dice, the random placement of tiles on a screen, etc. Manufacturers of EGMs have incorporated a number of enhancements to the EGMs to allow players to interact with the EGMs in new and more engaging ways. For example, early slot machines allowed player interaction by pulling a lever or arm on the machine. As mechanical slot machines were replaced by electronic slot machines, a range of new player interface devices became available to EGM designers and were subsequently incorporated into EGMs. Examples of such interface devices include electronic buttons, wheels, and, more recently, touchscreens and three dimensional display screens.

BRIEF SUMMARY

According to one embodiment, a mixed reality display system is disclosed. The mixed reality display system includes a processor circuit, and a memory coupled to the processor circuit. The memory includes machine-readable instructions that, when executed by the processor circuit, cause the processor circuit to determine a location of a user wearing a mixed reality viewer. The memory further includes machine-readable instructions that, when executed by the processor circuit, cause the processor circuit to generate a live video signal of a real-world scene associated with a field of view of the user wearing the mixed reality viewer, the real-world scene including a plurality of real-world elements. The memory further includes machine-readable instructions that, when executed by the processor circuit, cause the processor circuit to determine, based on the location of the user and the live video signal, an authorized region within the real-world scene including a plurality of authorized real-world elements that are authorized to be displayed to a third party. The memory further includes machine-readable instructions that, when executed by the processor circuit, cause the processor circuit to generate a mixed reality scene based on the live video signal, the mixed reality scene including the authorized real-world elements within the authorized region and a first virtual element that obscures one of the plurality of real-world elements of the live video signal that is not within the authorized region of the real-world scene. The memory further includes machine-readable instructions that, when executed by the processor circuit, cause the processor circuit to generate an output video signal of the mixed reality scene.

According to another embodiment, a method is disclosed. The method includes determining, by a processor circuit, a location of a user wearing a mixed reality display device. The method further includes generating a live video signal of a real-world scene associated with a field of view of the user, the real-world scene including a plurality of real-world elements. The method further includes determining, by the processor circuit based on the location of the user and the live video signal, an authorized region within the real-world scene including a plurality of authorized real-world elements that are authorized to be displayed to a third party. The method further includes generating a mixed reality scene based on the live video signal, the mixed reality scene including the authorized real-world elements within the authorized region of the real-world scene and a first virtual element that obscures one of the plurality of real-world elements of the live video signal that is not within the authorized region of the real-world scene. The method further includes generating an output video signal of the mixed reality scene.

According to another embodiment, a mixed reality display device is disclosed. The mixed reality display device includes a head-wearable frame, a display device coupled to the head-wearable frame, and a video capture device coupled to the frame. The mixed reality display device further includes a processor circuit, and a memory coupled to the processor circuit. The memory includes machine-readable instructions that, when executed by the processor circuit, cause the processor circuit to determine a location of a user wearing a mixed reality display device. The memory further includes machine-readable instructions that, when executed by the processor circuit, cause the video capture device to generate a live video signal of a real-world scene associated with a field of view of the user wearing the head-wearable frame, the real-world scene including a plurality of real-world elements. The memory further includes machine-readable instructions that, when executed by the processor circuit, cause the processor circuit to determine, based on the location of the user and the live video signal, an authorized region within the real-world scene including a plurality of authorized real-world elements that are authorized to be displayed to a third party. The memory further includes machine-readable instructions that, when executed by the processor circuit, cause the processor circuit to generate a mixed reality scene based on the live video signal, the mixed reality scene including the authorized real-world elements within the authorized region and a first virtual element that obscures one of the plurality of real-world elements of the live video signal that is not within the authorized region of the real-world scene. The memory further includes machine-readable instructions that, when executed by the processor circuit, cause the processor circuit to generate an output video signal of the mixed reality scene. The memory further includes machine-readable instructions that, when executed by the processor circuit, cause the processor circuit to transmit the output video signal to the display device. The memory further includes machine-readable instructions that, when executed by the processor circuit, cause display device to display the mixed reality scene to the user wearing the head-wearable frame.

DETAILED DESCRIPTION

Embodiments described herein relate to mixed reality systems and methods, and in particular to mixed reality systems and methods for displaying and recording authorized real-world and virtual elements. According to some embodiments, a mixed reality display system includes a processor circuit, and a memory coupled to the processor circuit. The memory includes machine-readable instructions that, when executed by the processor circuit, cause the processor circuit to determine a location of a user wearing the frame and generate a live video signal of a real-world scene including a plurality of real-world elements. The machine readable instructions further cause the processor circuit to determine an authorized region within the real-world scene including a plurality of authorized real-world elements that are authorized to be displayed to a third party, and generate a mixed reality including the authorized real-world elements within the authorized region and a first virtual element that obscures one of the plurality of real-world elements of the live video signal that is not within the authorized region of the real-world scene, and generate an output video signal of the mixed reality scene.

These and other embodiments allow differentiation between authorized and unauthorized persons, objects, and locations, when determining what mixed reality content to display and/or record. One technical problem with conventional systems for displaying or obscuring authorized and unauthorized elements is that each element in a scene may be analyzed individually, which increases computing overhead and reduces computing efficiency. One technical solution to these and other uniquely challenging problems is to first determine authorized and unauthorized regions of a scene so that individually analysis of each real-world element in the scene, as part of generating the mixed reality scene, may be avoided.

Figure 1:
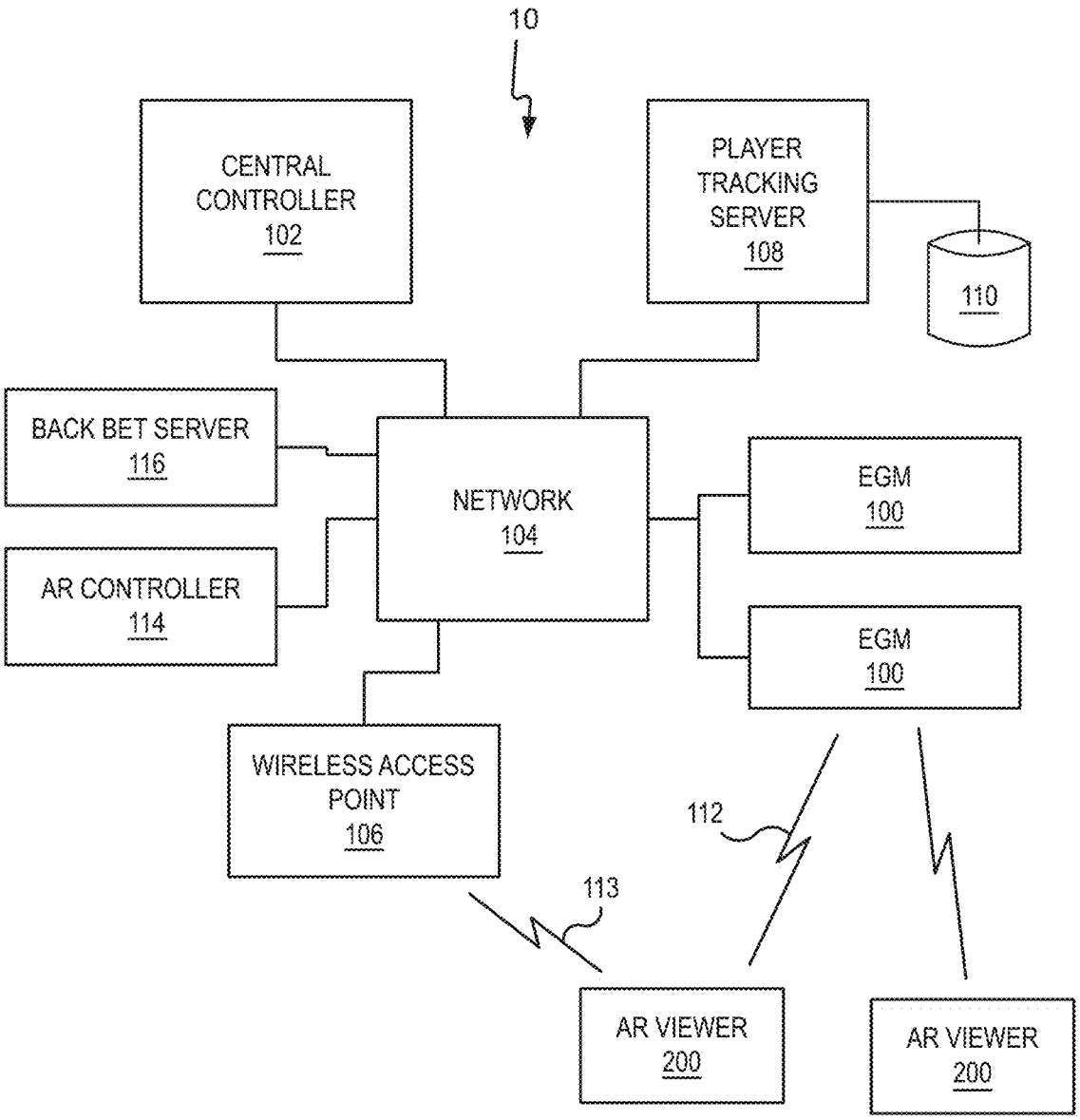
FIG. 1 is a schematic block diagram illustrating a network configuration for a plurality of gaming devices according to some embodiments.

Referring to FIG. 1, a gaming system 10 including a plurality of EGMs 100 is illustrated. The gaming system 10 may be located, for example, on the premises of a gaming establishment, such as a casino. The EGMs 100, which are typically situated on a casino floor, may be in communication with each other and/or at least one central controller 102 through a data network or remote communication link 104. The data communication network 104 may be a private data communication network that is operated, for example, by the gaming facility that operates the EGM 100. Communications over the data communication network 104 may be encrypted for security. The central controller 102 may be any suitable server or computing device which includes at least one processor circuit (such as a microprocessor or other processor, for example) and at least one memory or storage device. Each EGM 100 may include a processor circuit that transmits and receives events, messages, commands or any other suitable data or signal between the EGM 100 and the central controller 102. The EGM processor circuit is operable to execute such communicated events, messages or commands in conjunction with the operation of the EGM. Moreover, the processor circuit of the central controller 102 is configured to transmit and receive events, messages, commands or any other suitable data or signal between the central controller 102 and each of the individual EGMs 100. In some embodiments, one or more of the functions of the central controller 102 may be performed by one or more EGM processor circuits. Moreover, in some embodiments, one or more of the functions of one or more EGM processor circuits as disclosed herein may be performed by the central controller 102.

A wireless access point 106 provides wireless access to the data communication network 104. The wireless access point 106 may be connected to the data communication network 104 as illustrated in FIG. 1, or may be connected directly to the central controller 102 or another server connected to the data communication network 104.

A player tracking server 108 may also be connected through the data communication network 104. The player tracking server 108 may manage a player tracking account that tracks the player's gameplay and spending and/or other player preferences and customizations, manages loyalty awards for the player, manages funds deposited or advanced on behalf of the player, and other functions. Player information managed by the player tracking server 108 may be stored in a player information database 110.

As further illustrated in FIG. 1, a mixed reality viewer 200, or augmented reality (AR) viewer, is provided. The mixed reality viewer 200 communicates with one or more elements of the system 10 to render two dimensional (2D) and/or three dimensional (3D) content to a player of one of the EGMs 100 in a virtual space, while at the same time allowing the player to see objects in the real space around the player. That is, the mixed reality viewer 200 combines a virtual image with real images perceived by the user, including images of real objects as well as images displayed by the EGM 100. In this manner, the mixed reality viewer 200 "mixes" real and virtual reality into a single viewing experience for the player. In some embodiments, the mixed reality viewer 200 may be further configured to enable the player to interact with both the real and virtual objects displayed to the player by the mixed reality viewer 200.

The mixed reality viewer 200 communicates with one or more elements of the system 10 to coordinate the rendering of mixed reality images, and in some embodiments mixed reality 3D images, to the player. For example, in some embodiments, the mixed reality viewer 200 may communicate directly with an EGM 100 over a wireless interface 112, which may be a WiFi link, a Bluetooth link, an NFC link, etc. In other embodiments, the mixed reality viewer 200 may communicate with the data communication network 104 (and devices connected thereto, including EGMs) over a wireless interface 113 with the wireless access point 106. The wireless interface 113 may include a WiFi link, a Bluetooth link, an NFC link, etc. In still further embodiments, the mixed reality viewer 200 may communicate simultaneously with both the EGM 100 over the wireless interface 112 and the wireless access point 106 over the wireless interface 113. In these embodiments, the wireless interface 112 and the wireless interface 113 may use different communication protocols and/or different communication resources, such as different frequencies, time slots, spreading codes, etc. For example, in some embodiments, the wireless interface 112 may be a Bluetooth link, while the wireless interface 113 may be a WiFi link.

The wireless interfaces 112, 113 allow the mixed reality viewer 200 to coordinate the generation and rendering of mixed reality images to the player via the mixed reality viewer 200.

In some embodiments, the gaming system 10 includes a mixed reality controller, which may also be referred to herein and labeled in various figures as an augmented reality (AR) controller 114. The AR controller 114 may be a computing system that communicates through the data communication network 104 with the EGMs 100 and the mixed reality viewers 200 to coordinate the generation and rendering of virtual images to one or more players using the mixed reality viewers 200. The AR controller 114 may be implemented within or separately from the central controller 102.

In some embodiments, the AR controller 114 may coordinate the generation and display of the virtual images of the same virtual object to more than one player by more than one mixed reality viewer 200. As described in more detail below, this may enable multiple players to interact with the same virtual object together in real time. This feature can be used to provide a shared multiplayer experience to multiple players at the same time.

Moreover, in some embodiments, the AR controller 114 may coordinate the generation and display of the same virtual object to players at different physical locations, as will be described in more detail below.

The AR controller 114 may store a three dimensional wireframe map of a gaming area, such as a casino floor, and may provide the three dimensional wireframe map to the mixed reality viewers 200. The wireframe map may store various information about EGMs in the gaming area, such as the identity, type and location of various types of EGMs. The three dimensional wireframe map may enable a mixed reality viewer 200 to more quickly and accurately determine its position and/or orientation within the gaming area, and also may enable the mixed reality viewer 200 to assist the player in navigating the gaming area while using the mixed reality viewer 200. The generation of three dimensional wireframe maps is described in more detail below.

In some embodiments, at least some processing of virtual images and/or objects that are rendered by the mixed reality viewers 200 may be performed by the AR controller 114, thereby offloading at least some processing requirements from the mixed reality viewers 200.

A back bet server 116 may be provided to manage back bets placed using a mixed reality viewer 200 as described in more detail below. A mixed reality viewer 200 may communicate with the back bet server 116 through the wireless interface 113 and network 104.

Referring to FIGS. 2A to 2D, the mixed reality viewer 200 may be implemented in a number of different ways. For example, referring to FIG. 2A. in some embodiments, a mixed reality viewer 200A may be implemented as a 3D headset including a pair of semitransparent lenses 218 coupled to a head-wearable frame, on which images of virtual objects may be displayed within a field of view of a user wearing the frame. Different stereoscopic images may be displayed on the lenses 218 to create an appearance of depth, while the semitransparent nature of the lenses 218 allow the user to see both the real-world as well as the 3D image rendered on the lenses 218. The mixed reality viewer 200A may be implemented, for example, using a Hololens™ from Microsoft Corporation. The Microsoft Hololens includes a plurality of cameras and other sensors 220 that the device uses to obtain a live video signal for building a 3D model of the space around the user. The viewer 200A can generate a 3D image to display to the user that takes into account the real-world objects around the user and allows the user to interact with the 3D object.

The viewer 200A may further include other sensors, such as a gyroscopic sensor, a GPS sensor, one or more accelerometers, and/or other sensors that allow the viewer 200A to determine its position and orientation in space. In further embodiments, the viewer 200A may include one or more cameras that allow the viewer 200A to determine its position and/or orientation in space using visual simultaneous localization and mapping (VSLAM). The viewer 200A may further include one or more microphones and/or speakers that allow the user to interact audially with the device.

Figure 2A:
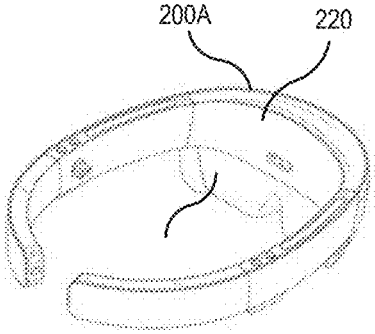
FIGS. 2A to 2D illustrate mixed reality viewers according to various embodiments.
Figure 2B:
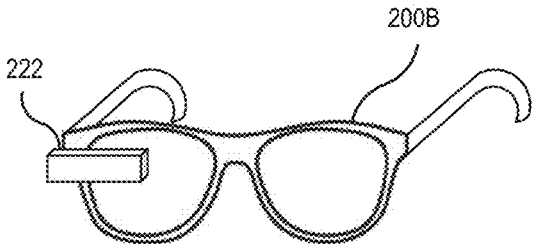

Referring to FIG. 2B, a mixed reality viewer 200B may be implemented as a pair of glasses including a transparent prismatic display 222 that displays an image to a single eye of the user. An example of such a device is the Google Glass device. Such a device may be capable of displaying images to the user while allowing the user to see the world around the user, and as such can be used as a mixed reality viewer. However, it will be appreciated that the viewer 200B may be incapable of displaying 3D images to the user.

Figure 2C:
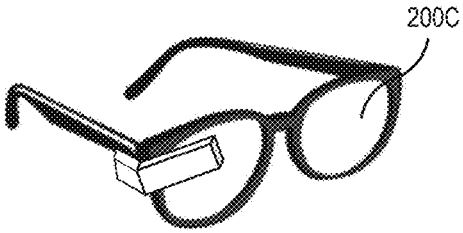
Figure 2D:
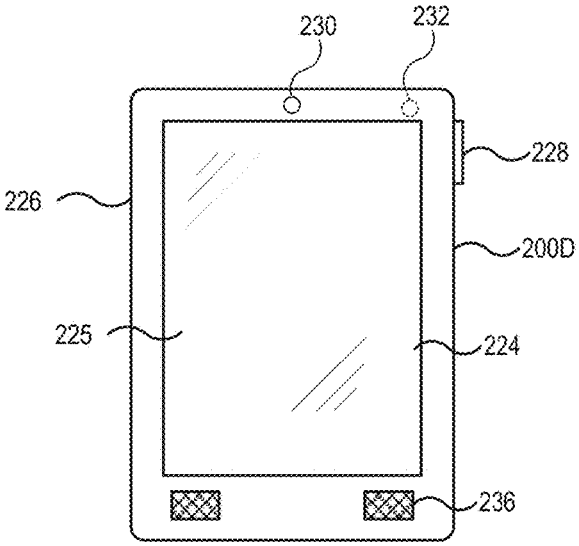

In other embodiments, referring to FIG. 2C, the mixed reality viewer may be implemented using a virtual retinal display device 200C. In contrast to devices that display an image within the field of view of the user, a virtual retinal display raster scans an image directly onto the retina of the user. Like the viewer 200B, the virtual retinal display device 200C combines the displayed image with surrounding light to allow the user to see both the real-world and the displayed image. However, also like the viewer 200B, the virtual retinal display device 200C may be incapable of displaying 3D images to the user.

In still further embodiments, a mixed reality viewer 200D may be implemented using a mobile wireless device, such as a mobile telephone, a tablet computing device, a personal digital assistant, or the like. The viewer 200D may be a handheld device including a housing 226 on which a touchscreen display device 224 including a digitizer 225 is provided. An input button 228 may be provided on the housing and may act as a power or control button. A rear facing camera 230 or other video capture device may be provided in a front face of the housing 226. The viewer 200D may further include a front facing camera 232 or other video capture device on a rear face of the housing 226. The viewer 200D may include one or more speakers 236 and a microphone 234. The viewer 200D may provide a mixed reality display by capturing a video signal using the front facing camera 232 and displaying the video signal on the display device 224, and also displaying a rendered image of a virtual object over the captured video signal. In this manner, the user may see both a mixed image of both a real object in front of the viewer 200D as well as a virtual object superimposed over the real object to provide a mixed reality viewing experience.

Figure 3A:
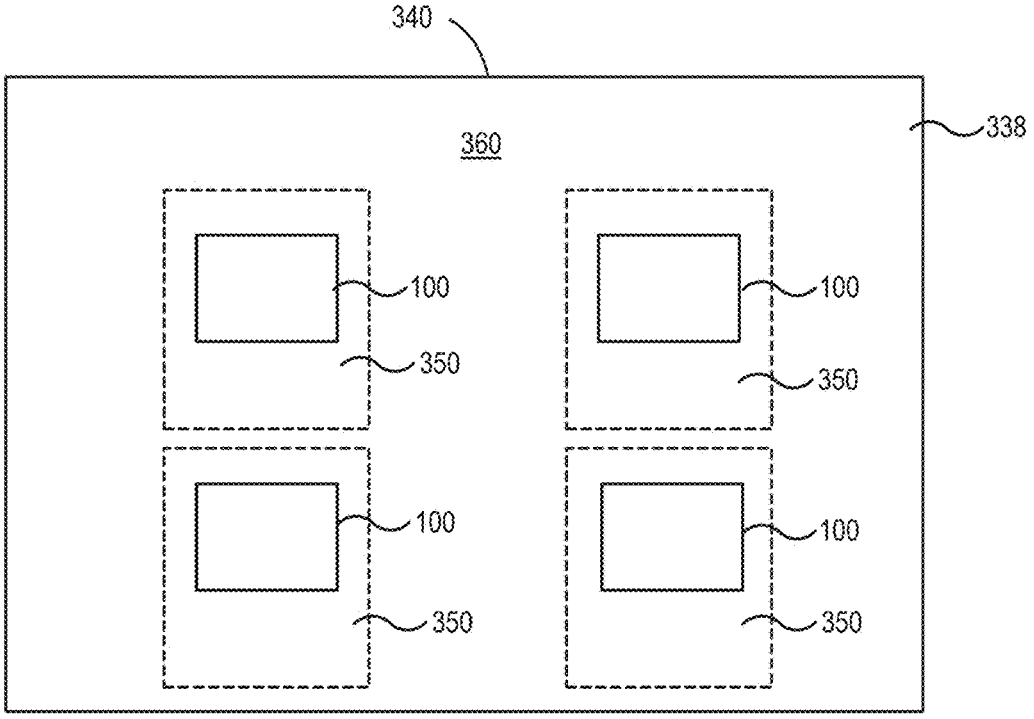
FIG. 3A is a map of a gaming area, such as a casino floor, including a plurality of gaming devices and authorized regions for providing mixed reality content.

FIG. 3A illustrates, in plan view, an example map 338 of a gaming area 340. The gaming area 340 may, for example, be a casino floor. The map 338 shows the location of a plurality of EGMs 100 within the gaming area 340. As will be appreciated, the locations of the EGMs 100 within a gaming area 340 are generally fixed, although a casino operator may relocate EGMs from time to time, such as when new EGMs are introduced, to create new traffic flow patterns within the gaming area 340, to feature or highlight certain games, etc. In this example, each EGM 100 is located within an authorized region 350 within the gaming area 340. The authorized region 350 may define a region in which a mixed reality viewer is authorized to display and/or record real-world elements, such as the EGM 100 or persons within the authorized region 350. The region outside a particular authorized region may be an unauthorized region 360. The authorized region 350 may define a region in which a mixed reality viewer 200 is not authorized to display and/or record real-world elements, such as the other EGMs 100 or persons outside the authorized region 350. Each authorized region 350 may be indicated by real-world elements, such as signage, floor markings, lighting, or other elements, to indicate the presence and/or boundaries of the authorized region 350. The real-world elements may be conspicuous, so as to call attention to the authorized region 350, inconspicuous, so as to allow a person seeking out the authorized region 350 to perceive its presence and/or boundaries, or may be invisible or hidden, so as to be detectable only by the mixed reality viewer 200 or other devices. As noted above, in order to assist the operation of the mixed reality viewers 200, the AR controller 114 may store a three dimensional wireframe map of the gaming area 340, and may provide the three dimensional wireframe map to the mixed reality viewers 200. In some embodiments, the three dimensional wireframe map 340 may be generated dynamically, such as by surveying the gaming area 340 with the mixed reality viewers 200 in real time to build a wireframe model for the three dimensional wireframe map.

Figure 3B:
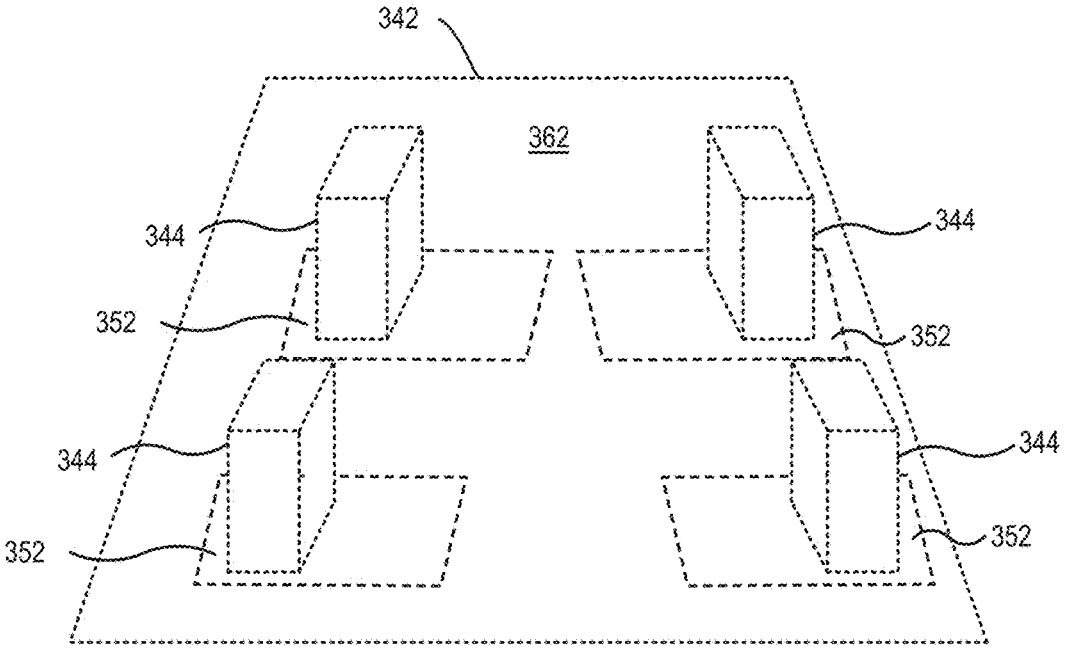
FIG. 3B is a 3D wireframe model of the gaming area of FIG. 3A.

An example of a wireframe map 342 is shown in FIG. 3B. The wireframe map 342 is a three-dimensional model of the gaming area 340. As shown in FIG. 3B, the wireframe map 342 includes wireframe EGM models 344 corresponding to the EGMs 100 that are physically in the gaming area 340, and includes wireframe authorized region models 352 corresponding to the authorized regions 350 surrounding the EGMs 100 in the gaming area 340. The wireframe map 342 may also include includes a wireframe authorized region model 362 corresponding to the unauthorized regions 360 surrounding the EGMs 100 in the gaming area 340. The wireframe EGM models 344 and wireframe authorized region models 352 may be pregenerated to correspond to various EGM form factors, such as single display EGMs, mechanical slot EGMs, dual display EGMs, etc. The pregenerated models may then be placed into the wireframe map, for example, by a designer or other personnel. The wireframe map 342 may be updated whenever the physical locations of EGMs 100 and/or authorized regions 350 in the gaming area 340 are changed.

In some embodiments, the wireframe map 342 may be generated automatically using a mixed reality viewer 200, such as a 3D headset, that is configured to perform a three-dimensional depth scan of its surroundings and generate a three dimensional model based on the scan results. Thus, for example, an operator using a mixed reality viewer 200A (FIG. 2A) may perform a walkthrough of the gaming area 340 while the mixed reality viewer 200A builds the 3D map of the gaming area.

The three dimensional wireframe map 342 may enable a mixed reality viewer 200 to more quickly and accurately determine its position and/or orientation within the gaming area. For example, a mixed reality viewer 200 may determine its location within the gaming area 340 using one or more position/orientation sensors. The mixed reality viewer 200 then builds a three dimensional map of its surroundings using depth scanning, and compares its sensed location relative to objects within the generated three dimensional map with an expected location based on the location of corresponding objects within the wireframe map 342. The mixed reality viewer 200 may calibrate or refine its position/orientation determination by comparing the sensed position of objects with the expected position of objects based on the wireframe map 342. Moreover, because the mixed reality viewer 200 has access to the wireframe map 342 of the entire gaming area 340, the mixed reality viewer 200 can be aware of objects or destinations within the gaming area 340 that it has not itself scanned. Processing requirements on the mixed reality viewer 200 may also be reduced because the wireframe map 342 is already available to the mixed reality viewer 200.

In some embodiments, the wireframe map 342 may store various information about EGMs in the gaming area, such as the identity, type, orientation and location of various types of EGMs, the locations of exits, bathrooms, courtesy desks, cashiers, ATMs, ticket redemption machines, etc. Such information may be used by a mixed reality viewer 200 to help the user navigate the gaming area. For example, if a user desires to find a destination within the gaming area, the user may ask the mixed reality viewer 200 for directions using a built-in microphone and voice recognition function in the mixed reality viewer 200 or use other hand gestures or eye/gaze controls tracked by the mixed reality viewer 200 (instead of or in addition to voice control). The mixed reality viewer 200 may process the request to identify the destination, and then may display a virtual object, such as a virtual path on the ground, virtual arrow, virtual sign, etc., to help the user to find the destination. In some embodiments, for example, the mixed reality viewer 200 may display a halo or glow around the destination to highlight it for the user, or have virtual 3D sounds coming from it so players could more easily find the machine.

According to some embodiments, a user of a mixed reality viewer 200 may use the mixed reality viewer to obtain information about players and/or EGMs on a casino gaming floor. The information may be displayed to the user on the mixed reality viewer 200 in a number of different ways such as by displaying images on the mixed reality viewer 200 that appear to be three dimensional or two dimensional elements of the scene as viewed through the mixed reality viewer 200. In general, the type and/or amount of data that is displayed to the user may depend on what type of user is using the mixed reality viewer 200 and, correspondingly, what level of permissions or access the user has. For example, a mixed reality viewer 200 may be operated in one of a number of modes, such as a player mode, an observer mode or an operator mode. In a player mode, the mixed reality viewer 200 may be used to display information about particular EGMs on a casino floor. The information may be generic information about an EGM or may be customized information about the EGM based on the identity or preferences of the user of the mixed reality viewer 200. In an observer mode, the mixed reality viewer 200 may be used to display information about particular EGMs on a casino floor or information about players of EGMs on the casino floor. In an operator mode, the mixed reality viewer 200 may also be used to display information about particular EGMs on a casino floor or information about players of EGMs on the casino floor, but the information may be different or more extensive than the information displayed to an observer. Each of these situations is described in more detail below.

Figure 4A:
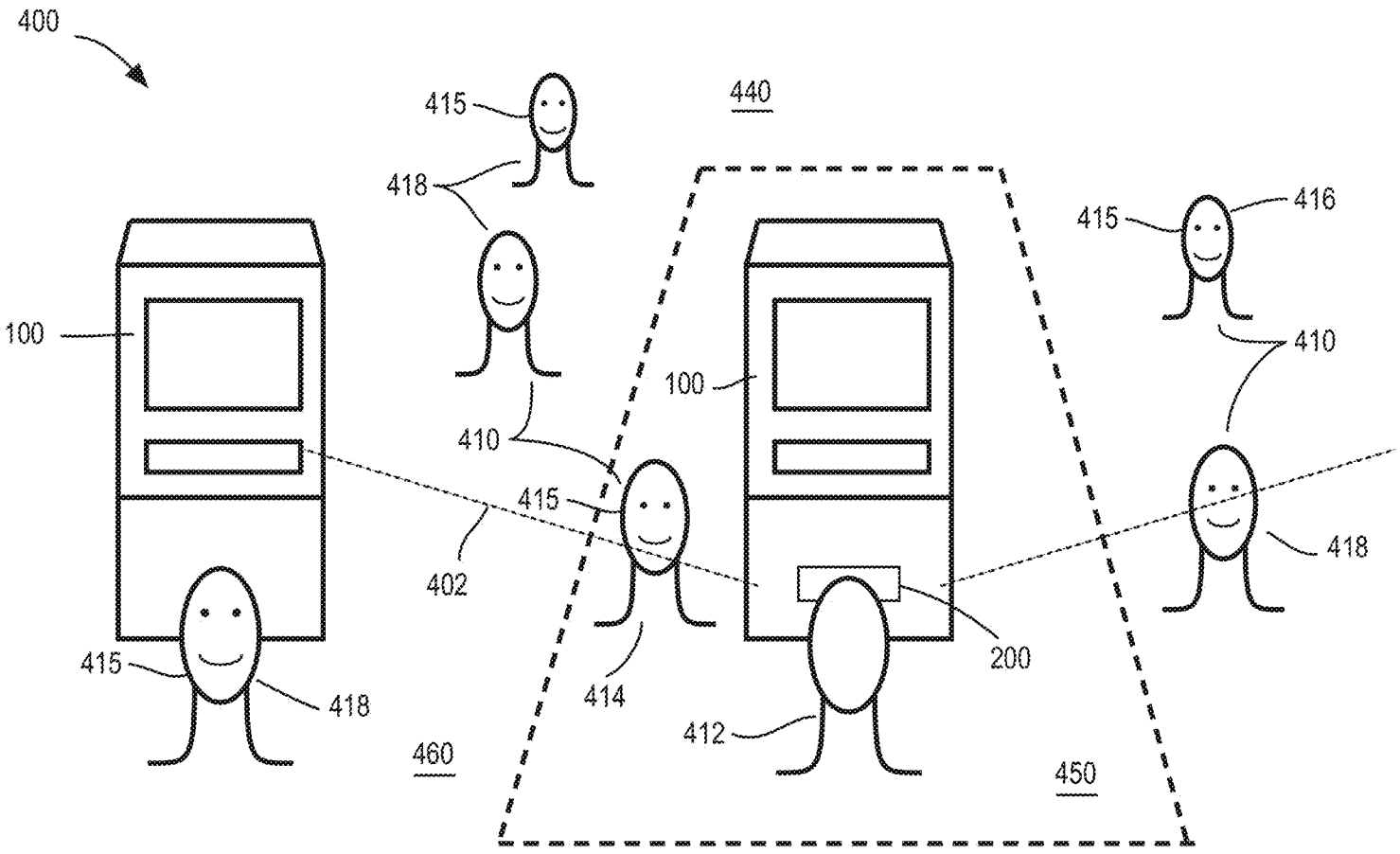
FIG. 4A is a diagram of a real-world scene being viewed by a user of a mixed reality device within an authorized region of a casino floor.
Figure 4B:
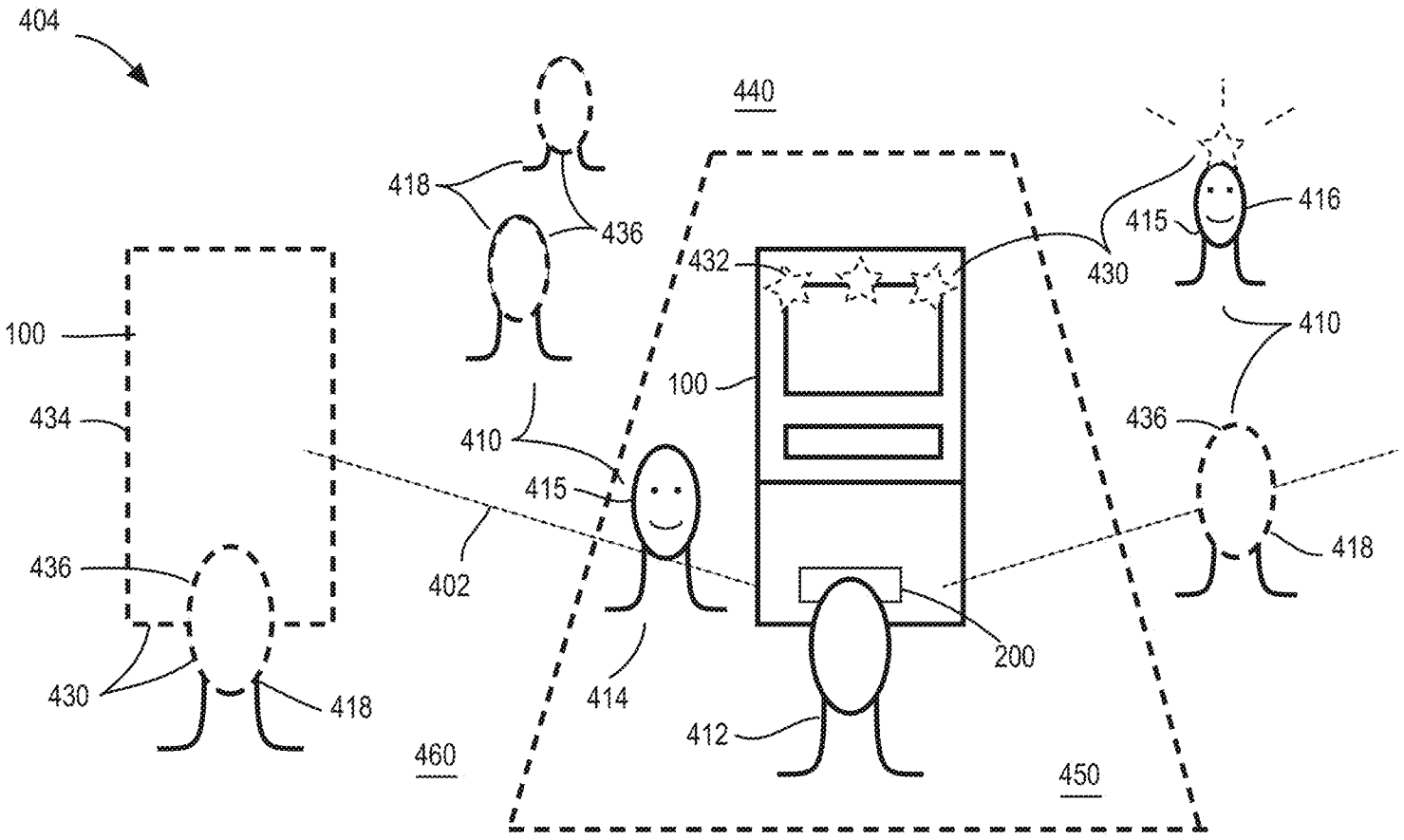
FIG. 4B is a diagram illustrating a mixed reality scene including real-world elements and virtual elements viewable by the user of the mixed reality viewer.
Figure 4C:
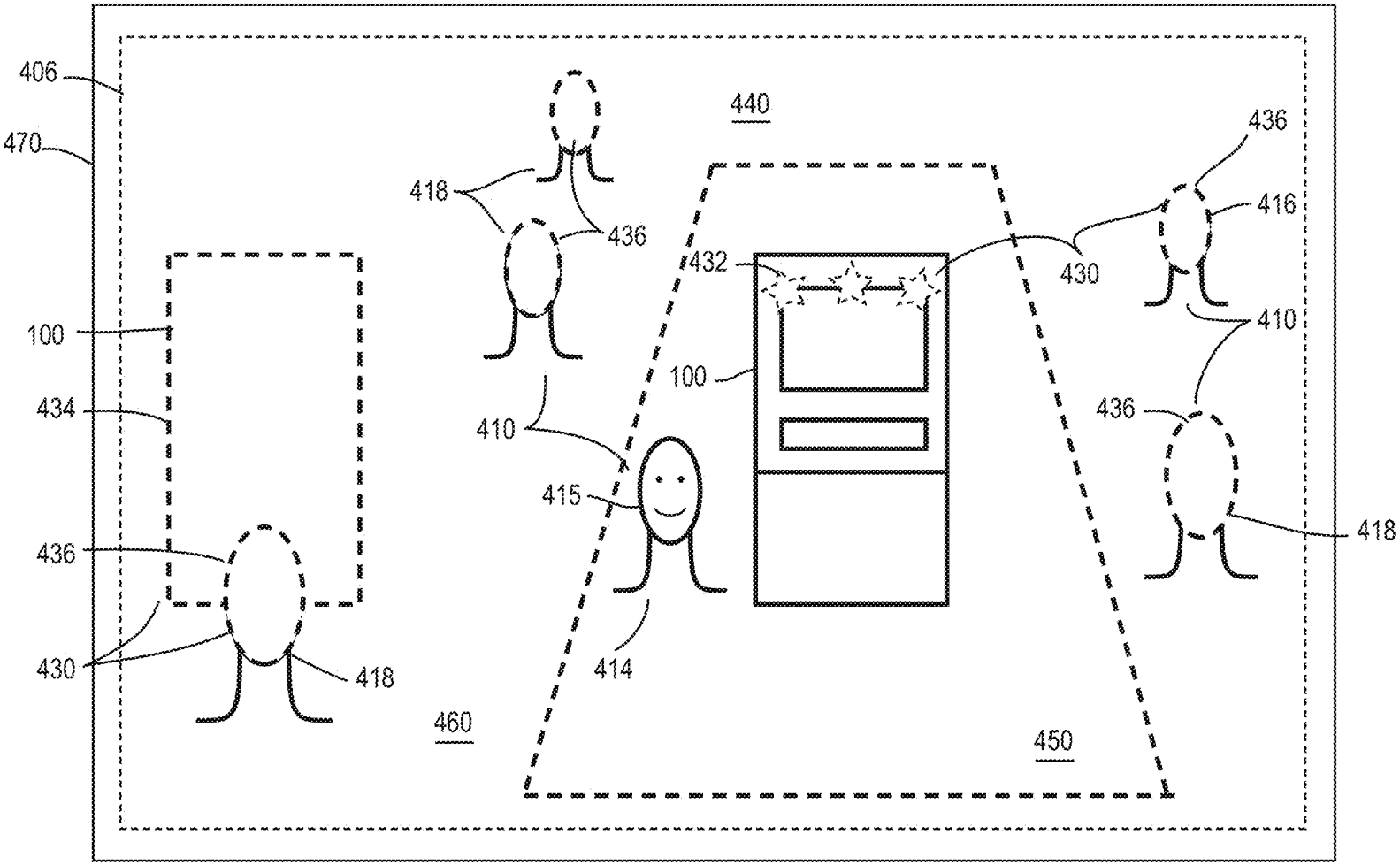
FIG. 4C is a diagram of a video display displaying a modified mixed reality scene corresponding to the mixed reality scene being viewed by the used of mixed reality viewer having different combinations of real-world elements and virtual elements.

Referring now to FIGS. 4A-4C, FIG. 4A is a diagram of a real-world scene 400 being viewed by a user 412 of a mixed reality viewer 200 within an authorized region 450 of a casino floor 440. The real-world scene 400 is defined by a field of view 402 of the user 412, and includes persons 410 and objects 420 in the authorized region 450 and outside the authorized region 450, i.e., within the unauthorized region 460, of the casino floor 440. Persons 410 within the real-world scene 400 may include authorized persons 414, such as family members or friends, casino employees 416, or strangers 418, for example. Faces 415 of the persons 410 are generally visible within the real-world scene 400. Objects 420 may include EGMs 100, such as the EGM 100 within the authorized region 450 or other EGMs 100 in the unauthorized region, or other objects within the real-world scene 400.

Referring now to FIG. 4B, a mixed reality scene 402 including certain real-world elements from the real-world scene 400 of FIG. 4A and virtual elements 418 viewable by the user 412 of the mixed reality viewer 200. For example, virtual game elements 432 may be displayed in association with the EGM 100 being played by the user 412 of the mixed reality viewer 200 to enhance game play. Virtual environment elements 434 and virtual character elements 436 may also be displayed around the user 412 to add to a sense of immersion by the user 412. In this example, virtual environment elements 434 may be used to obscure real-world elements, such as other EGMs 100, and virtual character elements 418 may be used to obscure certain persons 410, such as strangers 418. Authorized persons 414, on the other hand, may be unobscured so that the user 412 can view the authorized person's face 415. Persons 410 may be designated as authorized persons 414 based on any number of different criteria. For example, the user 412 may designate family members or friends as authorized persons 414, or an operator may separately authorize a casino employee 416, such as a server, dealer, or security personnel, so that the face 415 of the casino employee 416 remains visible to the user 412. Virtual alert elements 438 may also be used to draw the attention of the user 412, such as to call attention to an approaching casino employee 416 (e.g., a drink server).

In some embodiments, the entire region outside the authorized region 450 (i.e., the unauthorized region 460) may be replaced with virtual elements 430 so that the entire authorized region 450 appears to the user 412 to be surrounded by a virtual environment. Virtual character elements 436 may correspond to real-world persons 410 and may replace the real-world persons 410 in the mixed reality scene 404. Alternatively or in addition, virtual character elements 436 may be entirely virtual, and not based on any corresponding real-world person 410. Similarly, virtual environment elements 434 may correspond to real-world objects, such as other EGMs 100, and may replace the real-world objects in the mixed reality scene 404. Alternatively or in addition, virtual environment elements 434 may be entirely virtual, and not based on any corresponding real-world objects.

In embodiments where an entire region is replaced with virtual elements 410, it may be disorienting or dangerous for a user 412 to move around in a real-world space with real-world objects. In these and other embodiments, it may be desirable to ensure that the player 412 is within an authorized region 450 before enabling the display of some or all of the virtual elements 410 in the mixed reality scene 404.

In some embodiments, the mixed reality viewer 200 or another device may generate a video signal containing the mixed reality scene 404 or another mixed reality scene that is based on the mixed reality scene 404 being viewed by the user 412 of the mixed reality viewer 200. In this regard, FIG. 4C is a diagram of a video display device 470 displaying a modified mixed reality scene 406 corresponding to the mixed reality scene 404 of FIG. 4B that is being viewed by the user 412 of the mixed reality viewer 200. In this embodiment, the mixed reality scene 406 is customized for display on a publicly viewable video display device 470.

The video signal may also be recorded to a video storage medium, such as a videotape, computer-readable storage medium, or other medium, for later use by the user 412, the casino, or others. For example, the user 412 may want to have access to playback of a recording of the mixed reality scene 406, for example, for sharing the experience with friends and family and/or on social media, for example. The casino may want the ability to record and playback the mixed reality scene 406 for regulatory compliance (e.g., regulatory game recall), security, or verification of game results. For example, in case there is a regulatory or player dispute, such as a player claiming that a particular AR element of a game was or was not provided. The casino may also want the ability to record and playback the mixed reality scene 406 for marketing purposes, such as for use in advertisements, sharing videos on social media, displaying the video on a publicly viewable screen (e.g., above the EGM 100 or a bank of EGMs), or for a virtual reality playback experience. For example, the casino might want to advertise big wins or new features, and could playback video clips of players experiencing big wins or using the new features, which could be displayed on overhead displays, kiosks or other types of displays.

When recording mixed reality experiences that include real-world elements, it may be desirable to only record or only display particular elements. For example, persons within the casino may not want their faces recorded or displayed around the casino, or displayed online in social media. Similarly, a player at an adjacent EGM might not want their credit balance recorded or publicly displayed. These real-world elements can be obscured with virtual elements individually, or categorically, as desired.

The virtual elements may also be tailored to be consistent with a theme of a game. For example, if a player is playing a space-themed game at an EGM 100, the virtual elements of the mixed-reality scene may simulate a spaceship cockpit or hangar, and the real-world persons may be replaced with virtual characters from the game. Individual persons, such as authorized person known to the user, may be replaced or augmented with elements from particular characters, based on player preferences for example.

It should be understood that other features may be incorporated into mixed reality interfaces disclosed herein and other mixed reality interfaces. For example, virtual elements may be added to an EGM game, including additional virtual reels, a respin feature allowing a user to respin a virtual reel, a jitter, stutter or other visual change in the spinning of the reels, a multiplier feature for the user of the mixed reality interface that is not available to a player at the EGM interface alone, or one or more skill elements. Other features may include autohold or suggestions relating to the EGM game, e.g., showing a user a hint, such as which cards to hold or which items to select, a progressive to the game, such as a bank progressive or a wide area progressive, additional betting opportunities, such as additional paylines, a change in the theme of the game, including changing symbols, reels or other graphics and/or game sounds to change the theme, and market features, such as an autoplay function.

Figure 5:
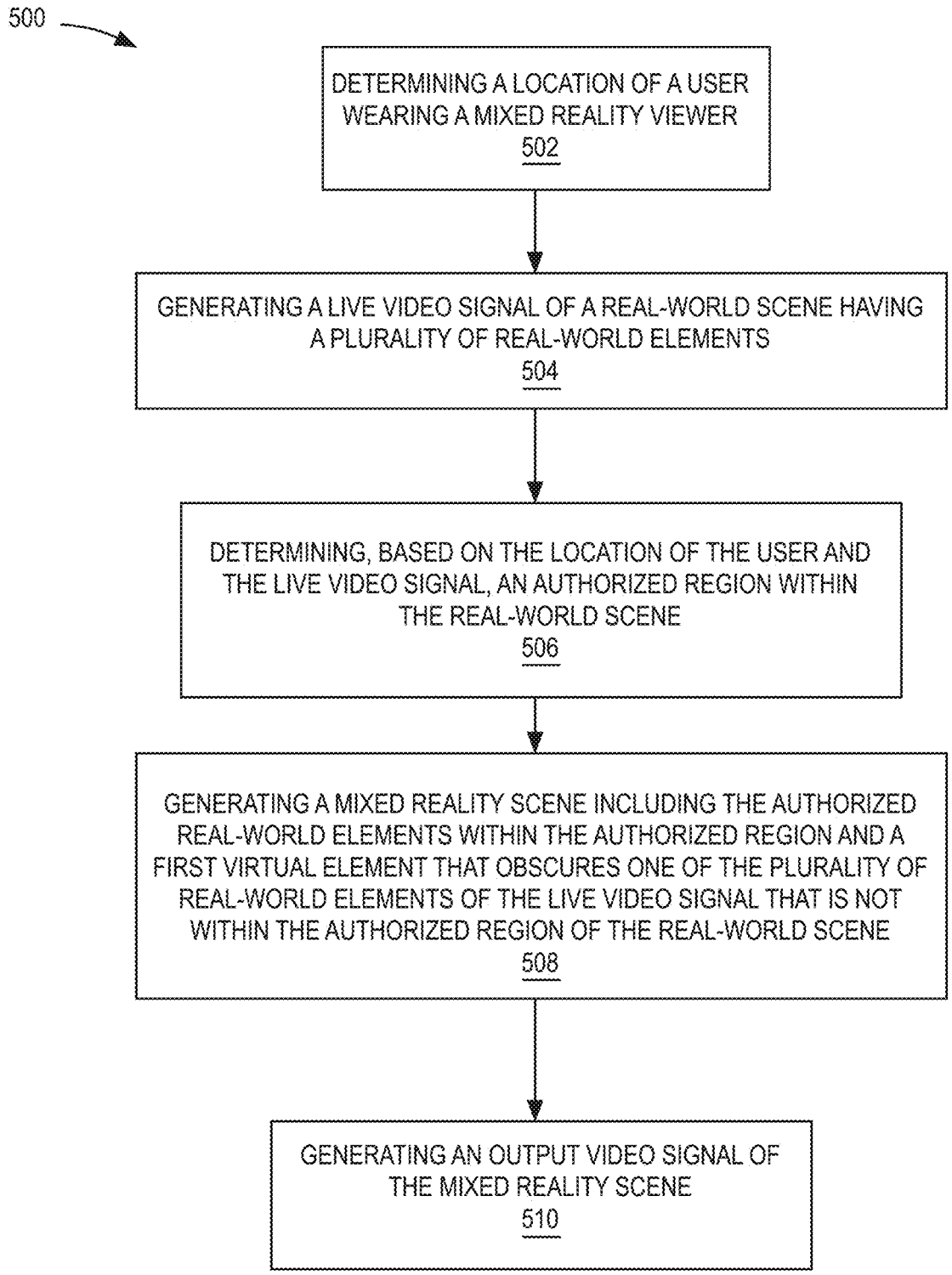
FIG. 5 is a flowchart illustrating operations of systems/methods according to some embodiments.

Referring now to FIG. 5, a flowchart illustrates operations of systems/methods according to some embodiments. The operations 500 include determining a location of a user wearing a mixed reality viewer (Block 502), such as the mixed reality viewer 200 discussed above. The operations 500 further include generating a live video signal of a real-world scene having a plurality of real-world elements (Block 504). The live video signal may be associated with a field of view of the user wearing the mixed reality viewer and may be generated by a camera of the mixed reality viewer, for example. The operations 500 further include determining, based on the location of the user and the live video signal, an authorized region within the real-world scene (Block 506). The authorized region may include a plurality of authorized real-world elements that are authorized to be displayed to a third party. In some embodiments, the term "authorized" may refer to elements, i.e., objects or people, that are permitted to be displayed and/or recorded by the mixed reality system. Determining the authorized region within the real-world scene may include accessing a mixed reality model corresponding to a real-world reference element, such as an EGM for example, within the authorized region of the real-world scene, and determining the authorized region within the real-world scene based on the mixed reality model. Alternatively or in addition, determining the authorized region within the real-world scene may include accessing a floor map including an indication of the authorized region, and determining the authorized region within the real-world scene based on the indication of the authorized region. Alternatively or in addition, determining the authorized region within the real-world scene may include determining a predetermined location within the real-world scene, and defining a predetermined area around the predetermined location within the real-world scene as the authorized region.

The operations 500 further include generating a mixed reality scene including the authorized real-world elements within the authorized region and a first virtual element that obscures one of the plurality of real-world elements of the live video signal that is not within the authorized region of the real-world scene (Block 508). For example, the face of a person standing outside the authorized region may be replaced in the mixed reality scene with a virtual face that may obscure the identity of the person outside the authorized region. The mixed reality scene may also include a second virtual element that obscures one of the plurality of real-world elements that is within the authorized region of the real-world scene. For example, virtual game elements for an EGM within the authorized region may be displayed as part of the mixed reality scene as well. Generating the mixed reality scene may include identifying the one of the plurality of real-world elements that is not within the authorized region, such as the face of a person, for example. Based on determining that one of the plurality of real-world elements is not authorized to be displayed to a third party, one of the plurality of real-world elements may be obscured with the first virtual element within the mixed reality scene. Alternatively or in addition, generating the mixed reality scene may include identifying the one of the plurality of real-world elements that is not within the authorized region, and determining that the one of the plurality of real-world elements is authorized to be displayed to the third party. Based on determining that one of the plurality of real-world elements is authorized, the one of the plurality of real-world elements may be displayed within the mixed reality scene. Generating the mixed reality scene may also be based on determining that a triggering condition being met, such as determining that a user has performed a particular predetermined movement and/or determining that a predetermined game event, such as a winning game result, has occurred. Triggering events may also trigger different operations, such as starting or stopping a recording, or starting or stopping display of the mixed reality scene.

The operations 500 further include generating an output video signal of the mixed reality scene (Block 510). In this embodiment, the output video signal may be displayed to the user of the mixed reality device, displayed on a publicly viewable display (Block 514), and/or recorded to a recording medium, for example. Generating the output video file may include displaying a second virtual element proximate to the one of the plurality of real-world elements within the mixed reality scene in the output video signal, based on determining that one of the plurality of real-world elements is authorized, to draw attention to the one of the plurality of real-world elements within the mixed reality scene in the output video signal.

Different mixed reality scenes and/or output video signals may also be generated for different uses as well, as discussed above. For example, the output video signal displayed to the user of the mixed reality device may allow the user to view the faces of some persons outside the authorized region, but another output video signal may include additional virtual elements that obscure the faces of those persons outside the authorized region, to preserve their privacy for example. For example, in addition to generating a first mixed reality scene that includes the authorized real-world elements and virtual elements that obscure certain real-world elements of the live video signal, a second mixed reality scene may also be generated that may include different authorized real-world elements and different virtual elements that obscure different real-world elements within the scene. Likewise, first and second output video signals may be generated corresponding to the first and second respective mixed reality scenes. Different output video signals may be displayed, e.g., to the user of the mixed reality viewer or on a publicly viewable display, or recorded, as desired. For example, one of the mixed reality scene may include a particular real-world element and/or a particular virtual element that is not part of the other mixed reality scene.

Figure 6A:
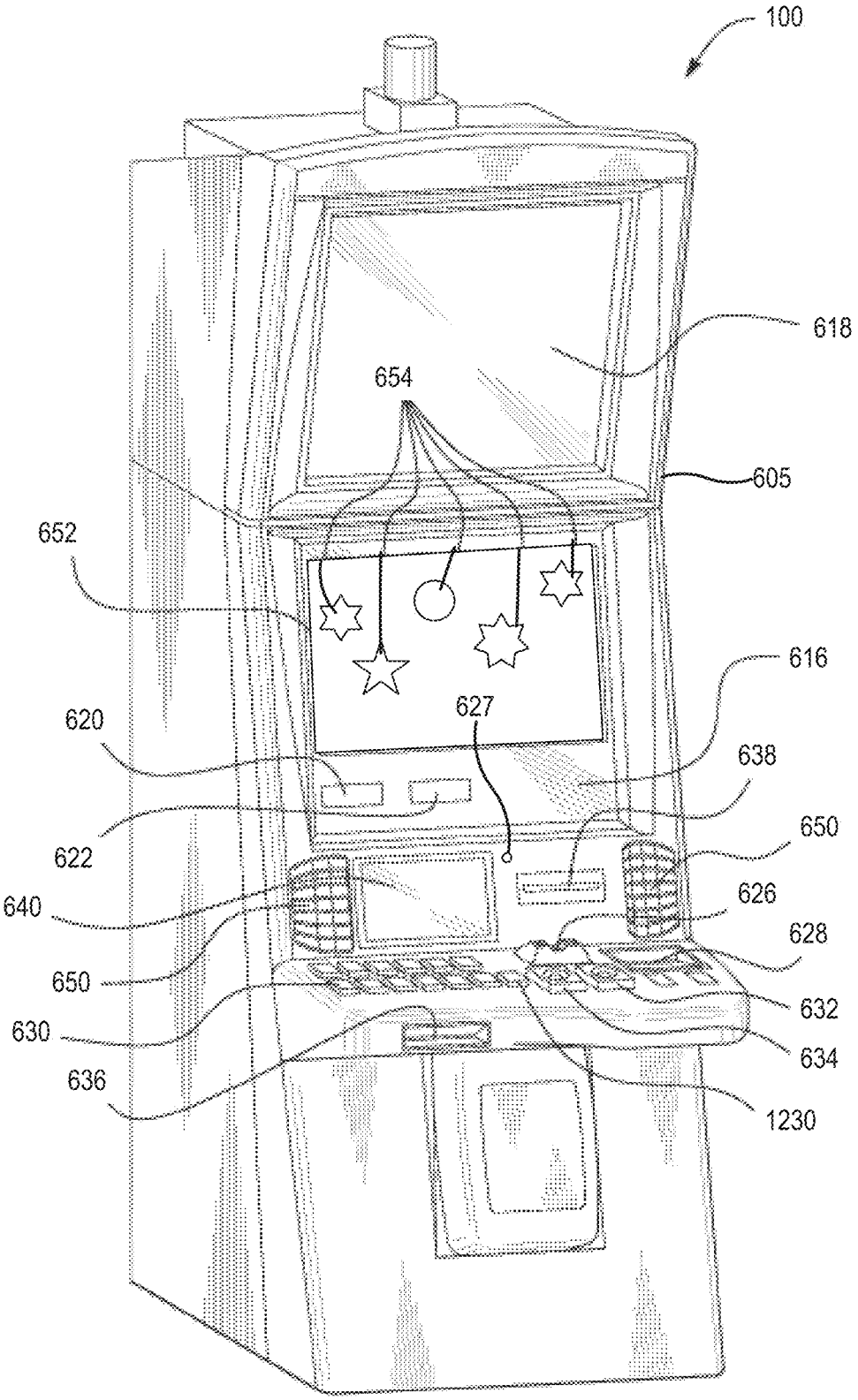
FIG. 6A is a perspective view of an electronic gaming device that can be configured according to some embodiments.
Figure 6B:
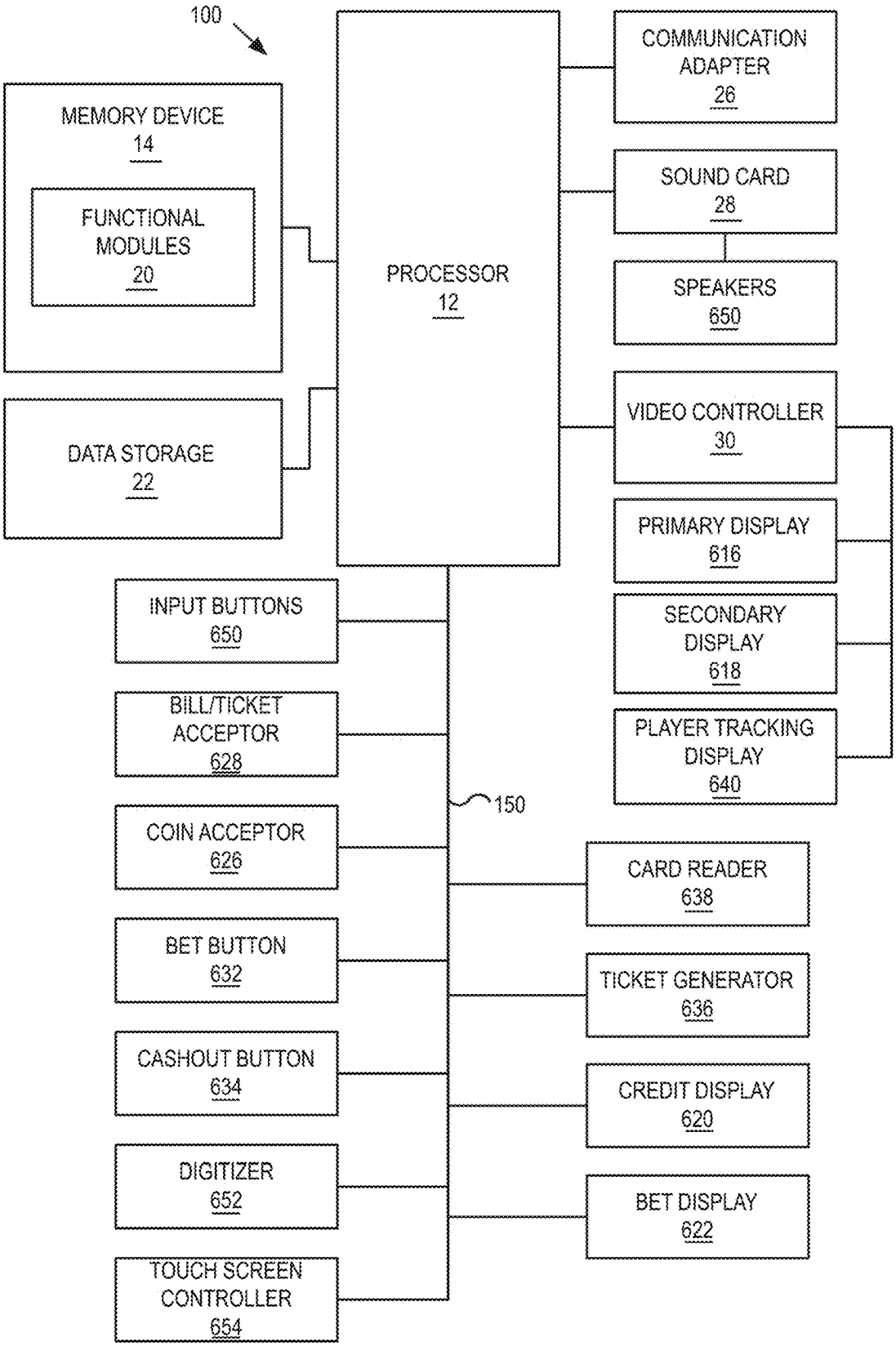
FIG. 6B is a schematic block diagram illustrating an electronic configuration for a gaming device according to some embodiments.
Figure 6C:
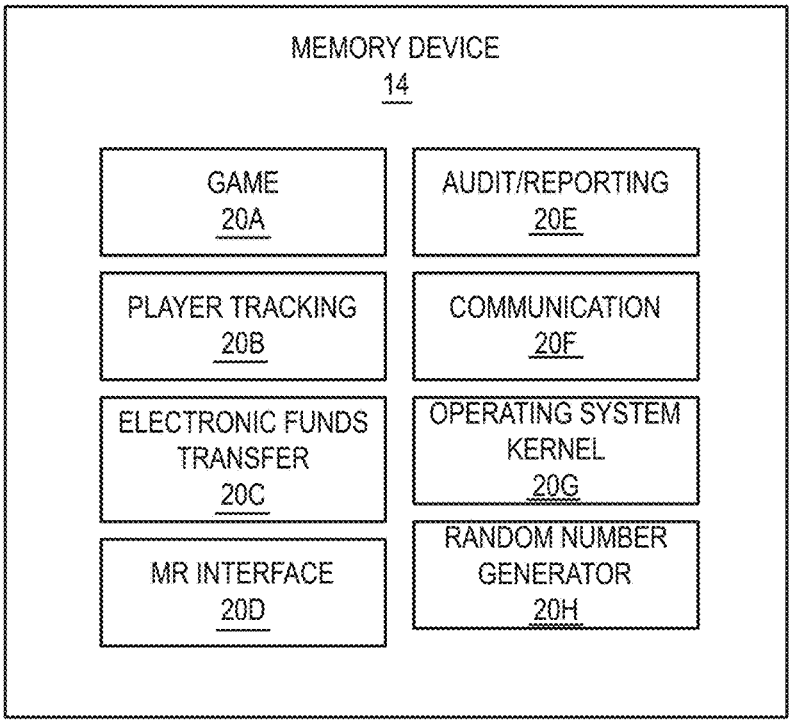
FIG. 6C is a block diagram that illustrates various functional modules of an electronic gaming device according to some embodiments.

An example of an electronic gaming machine (EGM) that can interact with mixed reality viewers according to various embodiments is illustrated in FIGS. 6A, 6B, and 6C in which FIG. 6A is a perspective view of an EGM 100 illustrating various physical features of the device, FIG. 6B is a functional block diagram that schematically illustrates an electronic relationship of various elements of the EGM 100, and FIG. 6C illustrates various functional modules that can be stored in a memory device of the EGM 100. The embodiments shown in FIGS. 6A to 6C are provided as examples for illustrative purposes only. It will be appreciated that EGMs may come in many different shapes, sizes, layouts, form factors, and configurations, and with varying numbers and types of input and output devices, and that embodiments are not limited to the particular EGM structures described herein.

EGMs may include a number of standard features, many of which are illustrated in FIGS. 6A and 6B. For example, referring to FIG. 6A, an EGM 100 may include a support structure, cabinet, or housing 605 which provides support for a plurality of displays, inputs, outputs, controls and other features that enable a player to interact with the EGM 100.

The EGM 100 illustrated in FIG. 6A includes a number of display devices, including a primary display device 616 located in a central portion of a housing 605 (e.g., a cabinet) and a secondary display device 618 located in an upper portion of the housing 605. It will be appreciated that one or more of the display devices 616, 618 may be omitted, or that the display devices 616, 618 may be combined into a single display device. The EGM 100 may further include a player tracking display 640, a credit display 620, and a bet display 622. The credit display 620 displays a player's current number of credits, cash, account balance or the equivalent. The bet display 622 displays a player's amount wagered.

The player tracking display 640 may be used to display a service window that allows the player to interact with, for example, their player loyalty account to obtain features, bonuses, comps, etc. In other embodiments, additional display screens may be provided beyond those illustrated in FIG. 6A.

The EGM 100 may further include a number of input devices that allow a player to provide various inputs to the EGM 100, either before, during or after a game has been played. For example, the EGM 100 may include a plurality of input buttons 630 that allow the player to select options before, during or after game play. The EGM may further include a game play initiation button 632 and a cashout button 634. The cashout button 634 is utilized to receive a cash payment or any other suitable form of payment corresponding to a quantity of remaining credits of a credit display.

In some embodiments, one or more input devices of the EGM 100 are one or more game play activation devices that are each used to initiate a play of a game on the EGM 100 or a sequence of events associated with the EGM 100 following appropriate funding of the EGM 100. The example EGM 100 illustrated in FIGS. 6A and 6B includes a game play activation device in the form of a game play initiation button 632. It should be appreciated that, in other embodiments, the EGM 100 begins game play automatically upon appropriate funding rather than upon utilization of the game play activation device.

In some embodiments, one or more input devices of the EGM 100 are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In some embodiments, one or more of the display screens may a touch-sensitive display that includes a digitizer 652 and a touchscreen controller 654 (FIG. 6B). The player may interact with the EGM 100 by touching virtual buttons on one or more of the display devices 616, 618, 640. Accordingly, any of the above described input devices, such as the input buttons 630, the game play initiation button 632 and/or the cashout button 634 may be provided as virtual buttons on one or more of the display devices 616, 618, 640.

Referring briefly to FIG. 6B, operation of the primary display device 616, the secondary display device 618 and the player tracking display 640 may be controlled by a video controller 30 that receives video data from a processor circuit 12 or directly from a memory device 14 and displays the video data on the display screen. The credit display 620 and the bet display 622 are typically implemented as simple LCD or LED displays that display a number of credits available for wagering and a number of credits being wagered on a particular game. Accordingly, the credit display 620 and the bet display 622 may be driven directly by the processor circuit 12. In some embodiments however, the credit display 620 and/or the bet display 622 may be driven by the video controller 30.

Referring again to FIG. 6A, the display devices 616, 618, 640 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 616, 618, 640 may include a touchscreen with an associated touchscreen controller 654 and digitizer 652. The display devices 616, 618, 640 may be of any suitable size, shape, and/or configuration. The display devices 616, 618, 640 may include flat or curved display surfaces.

The display devices 616, 618, 640 and video controller 30 of the EGM 100 are generally configured to display one or more game and/or non-game images, symbols, and indicia. In certain embodiments, the display devices 616, 618, 640 of the EGM 100 are configured to display any suitable visual representation or exhibition of the movement of objects; dynamic lighting; video images; images of people, characters, places, things, and faces of cards; and the like. In certain embodiments, the display devices 616, 618, 640 of the EGM 100 are configured to display one or more virtual reels, one or more virtual wheels, and/or one or more virtual dice. In other embodiments, certain of the displayed images, symbols, and indicia are in mechanical form. That is, in these embodiments, the display device 616, 618, 640 includes any electromechanical device, such as one or more rotatable wheels, one or more reels, and/or one or more dice, configured to display at least one or a plurality of game or other suitable images, symbols, or indicia.

The EGM 100 also includes various features that enable a player to deposit credits in the EGM 100 and withdraw credits from the EGM 100, such as in the form of a payout of winnings, credits, etc. For example, the EGM 100 may include a ticket generator 636, a bill/ticket acceptor 628, and a coin acceptor 626 that allows the player to deposit coins into the EGM 100.

While not illustrated in FIG. 6A, the EGM 100 may also include a payment mechanism, which may include a coin and/or bill acceptor, a coin and/or bill dispenser, an electronic card reader including a magnetic and/or chip-based reader, and/or a wireless reader including a near-field communication (NFC), Bluetooth, Wi-Fi, or other type of wireless interface, for example.

The EGM 100 may further include one or more speakers 650 controlled by one or more sound cards 28 (FIG. 6B). The EGM 100 illustrated in FIG. 6A includes a pair of speakers 650. In other embodiments, additional speakers, such as surround sound speakers, may be provided within or on the housing 605. Moreover, the EGM 100 may include built-in seating with integrated headrest speakers.

In various embodiments, the EGM 100 may generate dynamic sounds coupled with attractive multimedia images displayed on one or more of the display devices 616, 618, 640 to provide an audio-visual representation or to otherwise display full-motion video with sound to attract players to the EGM 100 and/or to engage the player during gameplay. In certain embodiments, the EGM 100 may display a sequence of audio and/or visual attraction messages during idle periods to attract potential players to the EGM 100. The videos may be customized to provide any appropriate information.

The EGM 100 may further include a card reader 638 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processor circuit determines the amount of funds entered and displays the corresponding amount on the credit or other suitable display as described above.

In some embodiments, the EGM 100 may include an electronic payout device or module configured to fund an electronically recordable identification card or smart card or a bank or other account via an electronic funds transfer to or from the EGM 100.

FIG. 6B is a block diagram that illustrates logical and functional relationships between various components of an EGM 100. As shown in FIG. 6B, the EGM 100 may include a processor circuit 12 that controls operations of the EGM 100. Although illustrated as a single processor circuit, multiple special purpose and/or general purpose processors and/or processor cores may be provided in the EGM 100. For example, the EGM 100 may include one or more of a video processor, a signal processor, a sound processor and/or a communication controller that performs one or more control functions within the EGM 100. The processor circuit 12 may be variously referred to as a "controller," "microcontroller," "microprocessor" or simply a "computer." The processor circuit may further include one or more application-specific integrated circuits (ASICs).

Various components of the EGM 100 are illustrated in FIG. 6B as being connected to the processor circuit 12. It will be appreciated that the components may be connected to the processor circuit 12 through a system bus 150, a communication bus and controller, such as a USB controller and USB bus, a network interface, or any other suitable type of connection.

The EGM 100 further includes a memory device 14 that stores one or more functional modules 20. Various functional modules 20 of the EGM 100 will be described in more detail below in connection with FIG. 6D.

The memory device 14 may store program code and instructions, executable by the processor circuit 12, to control the EGM 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The EGM 100 may further include a data storage device 22, such as a hard disk drive or flash memory. The data storage 22 may store program data, player data, audit trail data or any other type of data. The data storage 22 may include a detachable or removable memory device, including, but not limited to, a suitable cartridge, disk, CD ROM, DVD or USB memory device.

The EGM 100 may include a communication adapter 26 that enables the EGM 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the EGM 100 to communicate, for example, with a mobile communication device operated by a player.

The EGM 100 may include one or more internal or external communication ports that enable the processor circuit 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processor circuit 12 through a universal serial bus (USB) hub (not shown) connected to the processor circuit 12. U.S. Patent Application Publication No. 2004/0254014 describes a variety of EGMs including one or more communication ports that enable the EGMs to communicate and operate with one or more external peripherals.

In some embodiments, the EGM 100 may include a video capture device, such as a camera in communication with the processor circuit 12 (and possibly controlled by the processor circuit 12) that is selectively positioned to acquire an image of a player actively using the EGM 100 and/or the surrounding area of the EGM 100. In one embodiment, the camera may be configured to selectively acquire still or moving (e.g., video) images and may be configured to acquire the images in either an analog, digital or other suitable format. The display devices 616, 618, 640 may be configured to display the image acquired by the camera as well as display the visible manifestation of the game in split screen or picture-in-picture fashion. For example, the camera may acquire an image of the player and the processor circuit 12 may incorporate that image into the primary and/or secondary game as a game image, symbol or indicia.

Various functional modules of that may be stored in a memory device 14 of an EGM 100 are illustrated in FIG. 6C. Referring to FIG. 6C, the EGM 100 may include in the memory device 14 a game module 20A that includes program instructions and/or data for operating a hybrid wagering game as described herein. The EGM 100 may further include a player tracking module 20B, an electronic funds transfer module 20C, a wide area progressive module 20D, an audit/reporting module 20E, a communication module 20F, an operating system 20G and a random number generator 20H. The player tracking module 20B keeps track of the play of a player. The electronic funds transfer module 20C communicates with a back end server or financial institution to transfer funds to and from an account associated with the player. The wide area progressive (WAP) interface module 20D interacts with a remote WAP server to enable the EGM 100 to participate in a wide area progressive jackpot game as described in more detail below. The communication module 20F enables the EGM 100 to communicate with remote servers and other EGMs using various secure communication interfaces. The operating system kernel 20G controls the overall operation of the EGM 100, including the loading and operation of other modules. The random number generator 20H generates random or pseudorandom numbers for use in the operation of the hybrid games described herein.

In some embodiments, an EGM 100 may be implemented by a desktop computer, a laptop personal computer, a personal digital assistant (PDA), portable computing device, or other computerized platform. In some embodiments, the EGM 100 may be operable over a wireless network, such as part of a wireless gaming system. In such embodiments, the gaming machine may be a hand held device, a mobile device or any other suitable wireless device that enables a player to play any suitable game at a variety of different locations. It should also be understood that a gaming device or gaming machine as disclosed may include mechanical or electromechanical elements. Some game devices or game machines may facilitate play at a live table game, with the game device playing virtually at a live table game having otherwise real-world elements. It should be appreciated that a gaming device or gaming machine as disclosed herein may be a device that has obtained approval from a regulatory gaming commission or a device that has not obtained approval from a regulatory gaming commission.

Figure 6D:
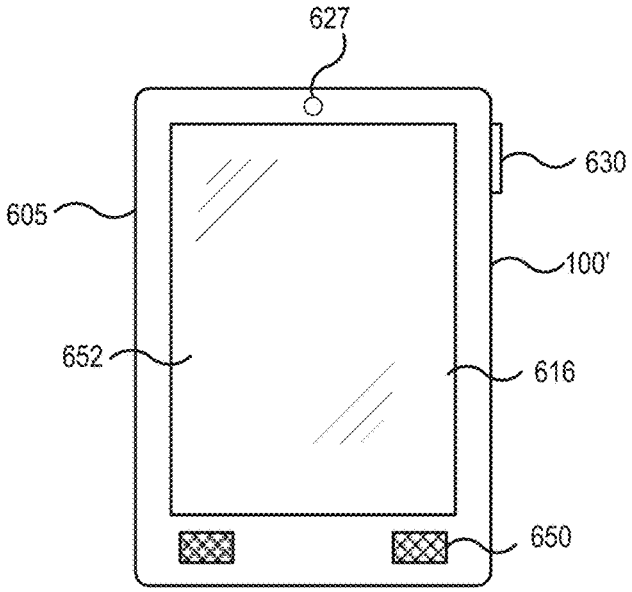
FIG. 6D is perspective view of a handheld electronic gaming device that can be configured according to some embodiments.

For example, referring to FIG. 6D, an EGM 100' may be implemented as a handheld device including a compact housing 605 on which is mounted a touchscreen display device 616 including a digitizer 652. An input button 630 may be provided on the housing and may act as a power or control button. A camera 627 may be provided in a front face of the housing 605. The housing 605 may include one or more speakers 650. In the EGM 100', various input buttons described above, such as the cashout button, gameplay activation button, etc., may be implemented as soft buttons on the touchscreen display device 616. Moreover, the EGM 100' may omit certain features, such as a bill acceptor, a ticket generator, a coin acceptor or dispenser, a card reader, secondary displays, a bet display, a credit display, etc. Credits can be deposited in or transferred from the EGM 100' electronically.

Figure 6E:
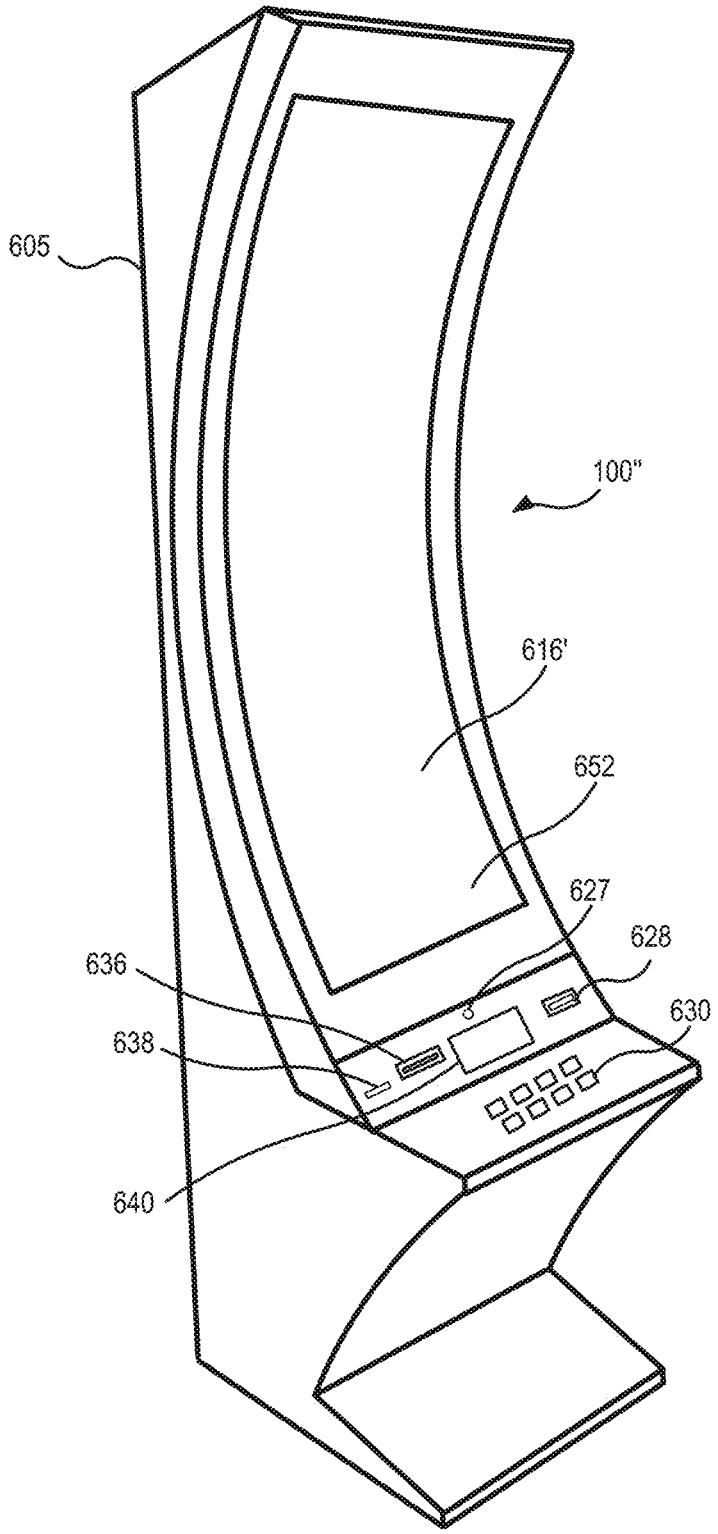
FIG. 6E is a perspective view of an electronic gaming device according to further embodiments.

FIG. 6E illustrates a standalone EGM 100" having a different form factor from the EGM 100 illustrated in FIG. 6A. In particular, the EGM 100" is characterized by having a large, high aspect ratio, curved primary display device 616' provided in the housing 605, with no secondary display device. The primary display device 616' may include a digitizer 652 to allow touchscreen interaction with the primary display device 616'. The EGM 600" may further include a player tracking display 640, a plurality of input buttons 630, a bill/ticket acceptor 628, a card reader 638, and a ticket generator 636. The EGM 100" may further include one or more cameras 627 to enable facial recognition and/or motion tracking.

Figure 7:
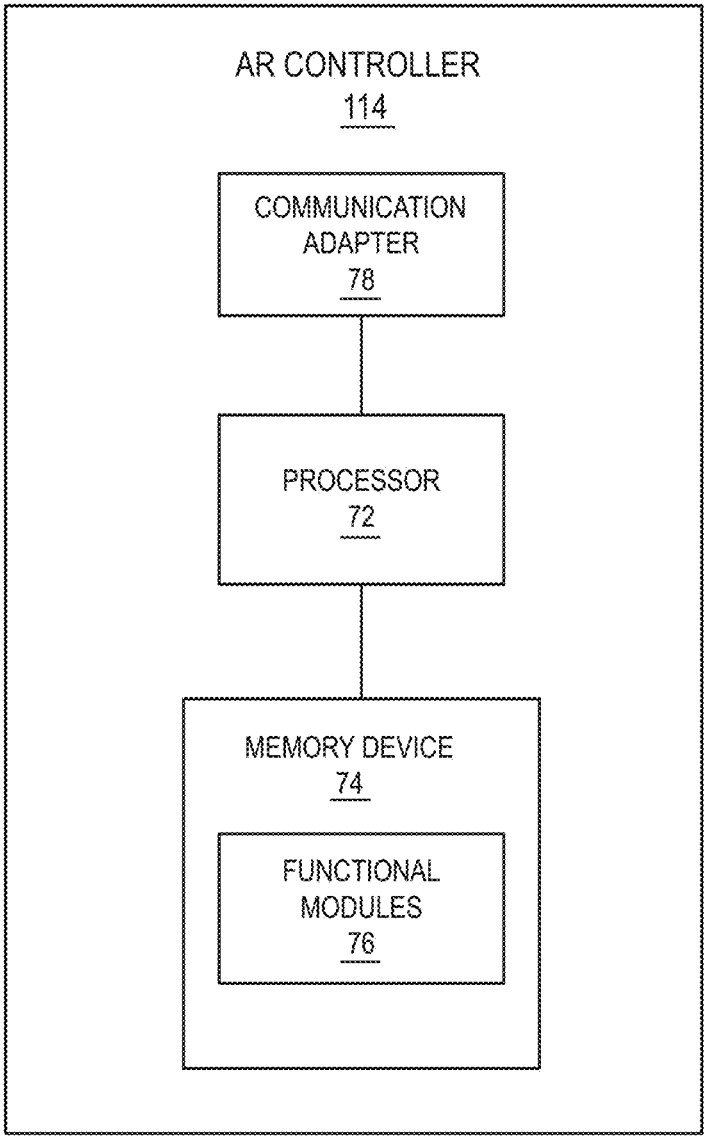
FIG. 7 is a schematic block diagram illustrating an electronic configuration for a mixed reality controller according to some embodiments.

FIG. 7 is a block diagram that illustrates various components of a AR controller 114 according to some embodiment. As shown in FIG. 7, the AR controller 114 may include a processor circuit 72 that controls operations of the AR controller 114. Although illustrated as a single processor circuit, multiple special purpose and/or general purpose processors and/or processor cores may be provided in the AR controller 114. For example, the EGM 100 may include one or more of a video processor, a signal processor, a sound processor and/or a communication controller that performs one or more control functions within the EGM 100. The processor circuit 72 may be variously referred to as a "controller," "microcontroller," "microprocessor" or simply a "computer." The processor circuit 72 may further include one or more application-specific integrated circuits (ASICs).

Various components of the AR controller 114 are illustrated in FIG. 7 as being connected to the processor circuit 72. It will be appreciated that the components may be connected to the processor circuit 72 through a system bus, a communication bus and controller, such as a USB controller and USB bus, a network interface, or any other suitable type of connection.

The AR controller 114 further includes a memory device 74 that stores one or more functional modules 76 for performing the operations described above.

The memory device 74 may store program code and instructions, executable by the processor circuit 72, to control the AR controller 114. The memory device 74 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The AR controller 114 may include a communication adapter 78 that enables the AR controller 114 to communicate with remote devices, such as EGMs 100 and/or a player tracking server 108 (FIG. 1) over a wired and/or wireless communication network, such as a local area network (LAN), wide area network (WAN), cellular communication network, or other data communication network.

The EGM 100 may include one or more internal or external communication ports that enable the processor circuit 72 to communicate with and to operate with internal or external peripheral devices, such as display screens, keypads, mass storage devices, microphones, speakers, and wireless communication devices. In some embodiments, internal or external peripheral devices may communicate with the processor circuit 72 through a universal serial bus (USB) hub (not shown) connected to the processor circuit 72.

Embodiments described herein may be implemented in various configurations for EGMs 100*s*, including but not limited to: (1) a dedicated EGM, wherein the computerized instructions for controlling any games (which are provided by the EGM) are provided with the EGM prior to delivery to a gaming establishment; and (2) a changeable EGM, where the computerized instructions for controlling any games (which are provided by the EGM) are downloadable to the EGM through a data network when the EGM is in a gaming establishment. In some embodiments, the computerized instructions for controlling any games are executed by at least one central server, central controller or remote host. In such a "thin client" embodiment, the central server remotely controls any games (or other suitable interfaces) and the EGM is utilized to display such games (or suitable interfaces) and receive one or more inputs or commands from a player. In another embodiment, the computerized instructions for controlling any games are communicated from the central server, central controller or remote host to an EGM local processor circuit and memory devices. In such a "thick client" embodiment, the EGM local processor circuit executes the communicated computerized instructions to control any games (or other suitable interfaces) provided to a player.

In some embodiments, an EGM may be operated by a mobile device, such as a mobile telephone, tablet other mobile computing device.

In some embodiments, one or more EGMs in a gaming system may be thin client EGMs and one or more EGMs in the gaming system may be thick client EGMs. In another embodiment, certain functions of the EGM are implemented in a thin client environment and certain other functions of the EGM are implemented in a thick client environment. In one such embodiment, computerized instructions for controlling any primary games are communicated from the central server to the EGM in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal EGMs, such as desktop computers, laptop computers, tablet computers or computing devices, personal digital assistants (PDAs), mobile telephones such as smart phones, and other mobile computing devices.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor circuit of the EGM executes the computerized instructions to control any games (or other suitable interfaces) displayed by the EGM.

In some embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit,"

"module," "component," or "system." Furthermore, various embodiments described herein may take the form of a computer program product including one or more computer readable media having computer readable program code embodied thereon.

Any combination of one or more computer readable media may be used. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any medium that can contain, or store a program for use by or in connection with a machine readable instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processor circuit of a general purpose computer, special purpose computer, or other programmable data processing apparatus to produce a machine, such that the instructions, which execute via the processor circuit of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The invention claimed is:

1. A mixed reality display system comprising:

a processor circuit; and a memory coupled to the processor circuit, the memory comprising stored instructions that, when executed by the processor circuit:

cause the processor circuit to determine a location of a user wearing a mixed reality viewer;

cause the processor circuit to generate a live video signal of a real-world scene associated with a field of view of the user wearing the mixed reality viewer, the real-world scene comprising a plurality of real-world elements;

cause the processor circuit to determine, based on the location of the user and the live video signal, an authorized region within the real-world scene comprising a plurality of authorized real-world elements that are authorized to be displayed to a third party;

cause the processor circuit to generate a mixed reality scene based on the live video signal, the mixed reality scene comprising the authorized real-world elements within the authorized region and a first virtual element that obscures one of the plurality of real-world elements of the live video signal that is not within the authorized region of the real-world scene; and cause the processor circuit to generate an output video signal of the mixed reality scene.

2. The mixed reality display system of claim 1, wherein the memory further comprises stored instructions that, when executed by the processor circuit:

cause the processor circuit to generate the mixed reality scene comprising a second virtual element that obscures one of the plurality of real-world elements that is within the authorized region of the real-world scene.

3. The mixed reality display system of claim 1, wherein the memory further comprises stored instructions that, when executed by the processor circuit:

cause the processor circuit to determine the authorized region within the real-world scene by:

accessing a mixed reality model corresponding to a real-world reference element within the authorized region of the real-world scene; and determining the authorized region within the real-world scene based on the mixed reality model.

4. The mixed reality display system of claim 3, wherein the real-world reference element is an electronic gaming machine.

5. The mixed reality display system of claim 1, wherein the memory further comprises stored instructions that, when executed by the processor circuit:

cause the processor circuit to determine the authorized region within the real-world scene by:

accessing a floor map comprising an indication of the authorized region; and determining the authorized region within the real-world scene based on the indication of the authorized region.

6. The mixed reality display system of claim 1, wherein the memory further comprises stored instructions that, when executed by the processor circuit:

cause the processor circuit to determine the authorized region within the real-world scene by:

determining a predetermined location within the real-world scene; and defining a predetermined area around the predetermined location within the real-world scene as the authorized region.

7. The mixed reality display system of claim 1, wherein the memory further comprises stored instructions that, when executed by the processor circuit:

cause the processor circuit to generate the mixed reality scene by:

identifying the one of the plurality of real-world elements that is not within the authorized region;

determining that the one of the plurality of real-world elements that is not within the authorized region is not authorized to be displayed to the third party; and based on determining that one of the plurality of real-world elements is not authorized, obscuring the one of the plurality of real-world elements with the first virtual element within the mixed reality scene.

8. The mixed reality display system of claim 1, wherein the one of the plurality of real-world elements is a face of a person that is not authorized to be displayed to the third party.

9. The mixed reality display system of claim 1, wherein the memory further comprises stored instructions that, when executed by the processor circuit:

cause the processor circuit to generate the mixed reality scene by:

identifying the one of the plurality of real-world elements that is not within the authorized region;

determining that the one of the plurality of real-world elements is authorized to be displayed to the third party; and based on determining that one of the plurality of real-world elements is authorized, displaying the one of the plurality of real-world elements within the mixed reality scene.

10. The mixed reality display system of claim 9, wherein the memory further comprises stored instructions that, when executed by the processor circuit:

cause the processor circuit to generate the output video signal by:

displaying a second virtual element proximate to the one of the plurality of real-world elements within the mixed reality scene in the output video signal, based on determining that one of the plurality of real-world elements is authorized, to draw attention to the one of the plurality of real-world elements within the mixed reality scene in the output video signal.

11. The mixed reality display system of claim 1, further comprising a mixed reality viewer comprising a head-wearable frame and a first display device coupled to the head-wearable frame, wherein the memory further comprises stored instructions that, when executed by the processor circuit:

cause the processor circuit to generate the mixed reality scene by:

generating a first mixed reality scene comprising the authorized real-world elements within the authorized region, the first virtual element that obscures one of the plurality of real-world elements of the live video signal that is not within the authorized region of the real-world scene, and a second virtual element that obscures another one of the plurality of real-world elements of the live video signal that is not within the authorized region of the real-world scene; and generating a second mixed reality scene comprising the first virtual element, wherein the second mixed reality scene does not comprise the second virtual element;

cause the processor circuit to generate the output video signal of the mixed reality scene by generating a first output video signal of the first mixed reality scene and generating a second output video signal of the second mixed reality scene.

12. The mixed reality display system of claim 11, further comprising a second display device, wherein the memory further comprises stored instructions that, when executed by the processor circuit:

cause the processor circuit to transmit the second output video signal to the first display device;

cause the first display device to display the second mixed reality scene to the user wearing the head-wearable frame;

cause the processor circuit to transmit the second output video signal to the second display device; and cause the second display device to display the first mixed reality scene so that the first mixed reality scene is viewable by the third party.

13. The mixed reality display system of claim 11, wherein the memory further comprises stored instructions that, when executed by the processor circuit:

cause the processor circuit to transmit the first output video signal to the first display device;

cause the first display device to display the first mixed reality scene to the user wearing the head-wearable frame; and cause the processor circuit to record the second output video signal to a video storage medium.

14. The mixed reality display system of claim 11, wherein the second mixed reality scene comprises a particular real-world element that is not part of the first mixed reality scene.

15. The mixed reality display system of claim 1, wherein the memory further comprises stored instructions that, when executed by the processor circuit:

prior to generating the output video signal, cause the processor circuit to determine that a triggering condition has occurred, wherein generating an output video signal occurs in response to determining that the triggering condition has occurred.

16. The mixed reality display system of claim 1, wherein the memory further comprises stored instructions that, when executed by the processor circuit:

cause the processor circuit to determine that a triggering condition has occurred by determining that the user has made a predetermined movement.

17. The mixed reality display system of claim 1, wherein the memory further comprises stored instructions that, when executed by the processor circuit:

cause the processor circuit to determine that a triggering condition has occurred by determining that a predetermined game event has occurred within a game being played by the user.

18. A method comprising:

determining, by a processor circuit, a location of a user wearing a mixed reality display device;

generating a live video signal of a real-world scene associated with a field of view of the user, the real-world scene comprising a plurality of real-world elements;

determining, by the processor circuit based on the location of the user and the live video signal, an authorized region within the real-world scene comprising a plurality of authorized real-world elements that are authorized to be displayed to a third party;

generating a mixed reality scene based on the live video signal, the mixed reality scene comprising the authorized real-world elements within the authorized region of the real-world scene and a first virtual element that obscures one of the plurality of real-world elements of the live video signal that is not within the authorized region of the real-world scene; and generating an output video signal of the mixed reality scene.

19. The method of claim 18, wherein generating the mixed reality scene further comprises:

generating a first mixed reality scene comprising the authorized real-world elements within the authorized region, the first virtual element that obscures one of the plurality of real-world elements of the live video signal that is not within the authorized region of the real-world scene, and a second virtual element that obscures another one of the plurality of real-world elements of the live video signal that is not within the authorized region of the real-world scene; and generating a second mixed reality scene comprising the first virtual element, wherein the second mixed reality scene does not comprise the second virtual element, and wherein generating the output video signal of the mixed reality scene further comprises generating a first output video signal of the first mixed reality scene and generating a second output video signal of the second mixed reality scene.

20. A mixed reality display device comprising:

a head-wearable frame;

a display device coupled to the head-wearable frame;

a video capture device coupled to the head-wearable frame;

a processor circuit; and a memory coupled to the processor circuit, the memory comprising stored instructions that, when executed by the processor circuit:

cause the processor circuit to determine a location of a user wearing a mixed reality display device;

cause the video capture device to generate a live video signal of a real-world scene associated with a field of view of the user wearing the head-wearable frame, the real-world scene comprising a plurality of real-world elements;

cause the processor circuit to determine, based on the location of the user and the live video signal, an authorized region within the real-world scene comprising a plurality of authorized real-world elements that are authorized to be displayed to a third party;

cause the processor circuit to generate a mixed reality scene based on the live video signal, the mixed reality scene comprising the authorized real-world elements within the authorized region and a first virtual element that obscures one of the plurality of real-world elements of the live video signal that is not within the authorized region of the real-world scene;

cause the processor circuit to generate an output video signal of the mixed reality scene;

cause the processor circuit to transmit the output video signal to the display device; and cause display device to display the mixed reality scene to the user wearing the head-wearable frame.

* * * * *